US011626683B2

(12) United States Patent
Miyamura et al.

(10) Patent No.: US 11,626,683 B2
(45) Date of Patent: Apr. 11, 2023

(54) CONNECTOR WITH RETAINER

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Tetsuya Miyamura, Mie (JP); Kenji Makino, Mie (JP); Akiko Suzuki, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 23 days.

(21) Appl. No.: 17/415,148

(22) PCT Filed: Nov. 28, 2019

(86) PCT No.: PCT/JP2019/046486

§ 371 (c)(1),
(2) Date: Jun. 17, 2021

(87) PCT Pub. No.: WO2020/129563

PCT Pub. Date: Jun. 25, 2020

(65) Prior Publication Data

US 2022/0059963 A1 Feb. 24, 2022

(30) Foreign Application Priority Data

Dec. 18, 2018 (JP) ..... JP2018-235996

(51) Int. Cl.
*H01R 13/436* (2006.01)
*H01R 13/642* (2006.01)
*H01R 13/46* (2006.01)

(52) U.S. Cl.
CPC ..... *H01R 13/4367* (2013.01); *H01R 13/642* (2013.01); *H01R 13/46* (2013.01)

(58) Field of Classification Search
CPC ..... H01R 13/4367; H01R 13/436; H01R 13/642; H01R 13/46; H01R 13/4368; H01R 13/40; H01R 13/64
(Continued)

(56) References Cited

U.S. PATENT DOCUMENTS 6,435,894 B2 * 8/2002 Little ..... H01R 13/7032 439/352
6,893,277 B2 * 5/2005 Parrish ..... H01R 13/639 439/352
(Continued)

FOREIGN PATENT DOCUMENTS

JP H01-092773 U 6/1989
JP 2002-015807 A 1/2002
JP 2010-267523 A 11/2010

OTHER PUBLICATIONS

International Search Report dated Feb. 25, 2020 for WO 2020/129563 A1 (4 pages).

*Primary Examiner* — Harshad C Patel
(74) *Attorney, Agent, or Firm* — Venjuris, P.C.

(57) ABSTRACT

It is aimed to provide a connector capable of properly exhibiting functions of a detection piece. A connector is provided with a housing (10) including a cavity (16), a terminal fitting (40) to be inserted into the cavity (16) from behind and including a tubular box portion (41) having open front and rear surfaces, a tab (31) of a mating terminal fitting (30) being inserted into the box portion (41) from front, and a retainer (60) to be mounted into the housing (10) and including a detection piece (64) capable of coming into contact with a rear end of the box portion (41). The detection piece (64) includes a recess (73) for avoiding interference with the tab (31) passed through the box portion (41).

3 Claims, 8 Drawing Sheets

(58) Field of Classification Search
USPC ..... 439/352, 345, 346, 362, 364, 578, 619, 439/660, 678, 699.1, 708, 723, 752, 290, 439/607.01, 850, 852
See application file for complete search history.

(56) References Cited

U.S. PATENT DOCUMENTS

| | | | | |
|---|---|---|---|---|
| 7,121,867 | B2 * | 10/2006 | Annecke | H01R 13/6273 439/352 |
| 8,096,835 | B2 * | 1/2012 | Dufour | H01R 13/506 439/620.05 |
| 9,660,379 | B1 * | 5/2017 | Burkman | H01R 13/5841 |
| 9,762,002 | B1 * | 9/2017 | Matsumoto | H01R 13/5829 |
| 10,516,229 | B2 * | 12/2019 | Nakamura | H01R 13/4223 |
| 10,998,669 | B2 * | 5/2021 | Mamiya | H01R 13/447 |
| 11,329,412 | B2 * | 5/2022 | Hung | H01R 13/405 |
| 2001/0006860 | A1 * | 7/2001 | Nimura | H01R 13/7197 439/620.01 |
| 2007/0105442 | A1 * | 5/2007 | Gunreben | H01R 43/02 439/607.01 |
| 2010/0197177 | A1 * | 8/2010 | Myer | H01R 13/187 439/852 |
| 2012/0329341 | A1 * | 12/2012 | Morikawa | H01R 4/185 439/866 |

* cited by examiner

CONNECTOR WITH RETAINER

CROSS REFERENCE TO RELATED APPLICATIONS

This application is a national phase of PCT application No. PCT/JP2019/046486, filed on 28 Nov. 2019, which claims priority from Japanese patent application No. 2018-235996, filed on 18 Dec. 2018, all of which are incorporated herein by reference.

TECHNICAL FIELD

The present disclosure relates to a connector.

BACKGROUND

A connector disclosed in Patent Document 1 is provided with a housing including a cavity, a terminal fitting to be inserted into the cavity from behind and having a tubular fitting portion (hereinafter, referred to as a box portion) in a front end part, and a retainer to be mounted into the housing and having a deflective locking piece (hereinafter, referred to as a detection piece). A tab of a mating terminal fitting is inserted into the box portion for connection. The detection piece comes into contact with the rear end of the box portion to restrict the escape of the terminal fitting from the cavity and detect an inserted state of the terminal fitting.

PRIOR ART DOCUMENT

Patent Document

Patent Document 1: JP 2002-015807 A

SUMMARY OF THE INVENTION

Problems to be Solved

In recent years, there has been a tendency to miniaturize connectors, and the tip part of the tab might protrude rearward from the rear end of the box portion within an error or dimensional tolerance range. If the tip part of the tab protrudes from the box portion and comes into contact with the detection piece, there has been a problem that functions such as a detection function of the detection piece are not properly exhibited.

Accordingly, it is aimed to provide a connector capable of properly exhibiting functions of a detection piece.

Means to Solve the Problem

The present disclosure is directed to a connector with a housing including a cavity, a terminal fitting to be inserted into the cavity from behind, the terminal fitting including a tubular box portion having open front and rear surfaces, a tab of a mating terminal fitting being inserted into the box portion from front, and a retainer to be mounted into the housing, the retainer including a detection piece capable of coming into contact with a rear end of the box portion, the detection piece including a recess for avoiding interference with the tab passed through the box portion.

Effect of the Invention

According to the present disclosure, it is possible to provide a connector capable of properly exhibiting functions of a detection piece.

DETAILED DESCRIPTION TO EXECUTE THE INVENTION

Description of Embodiments of Present Disclosure

Figure 1:
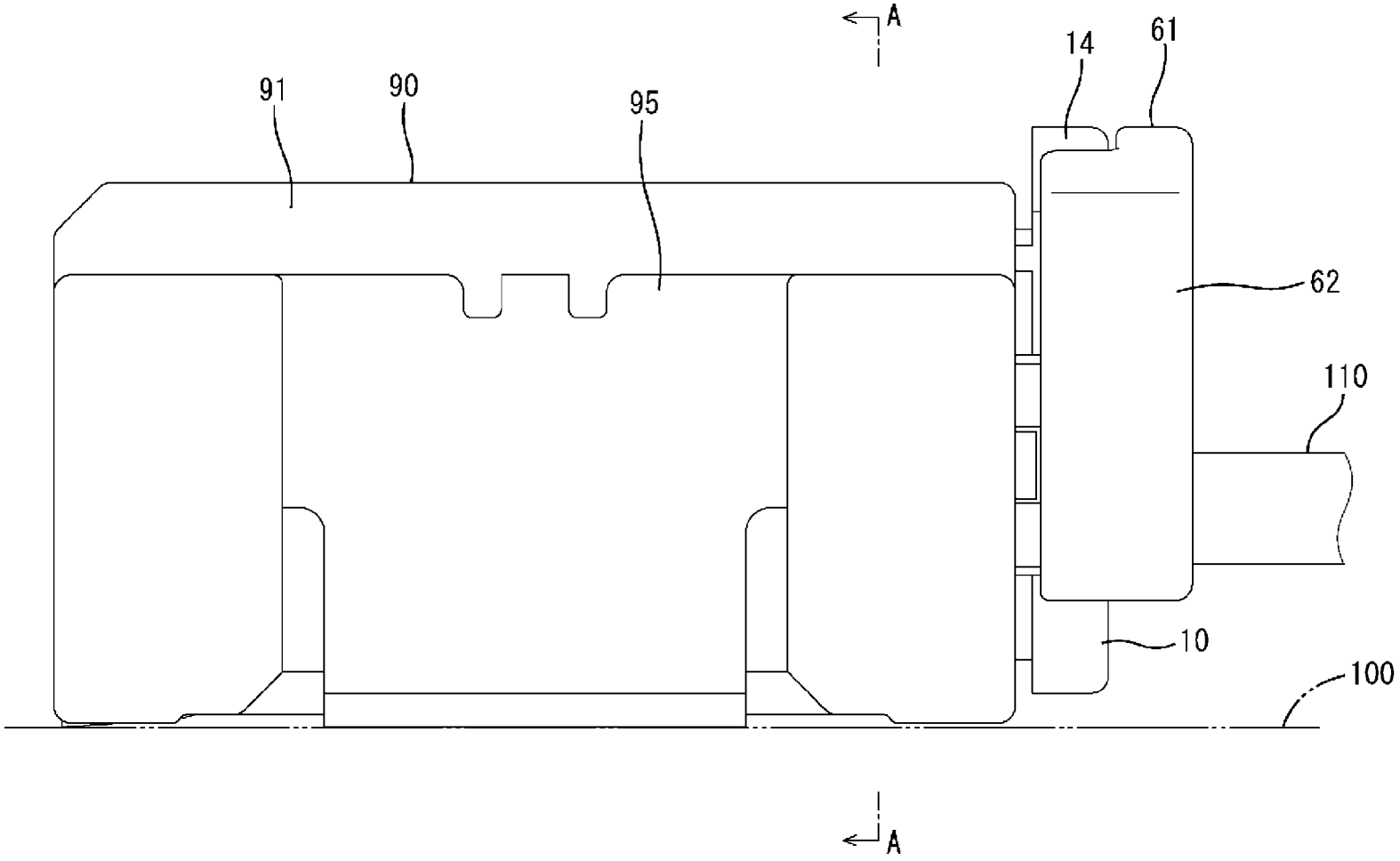
FIG. 1 is a side view showing a state where a housing is properly connected to a mating housing in one embodiment.
Figure 2:
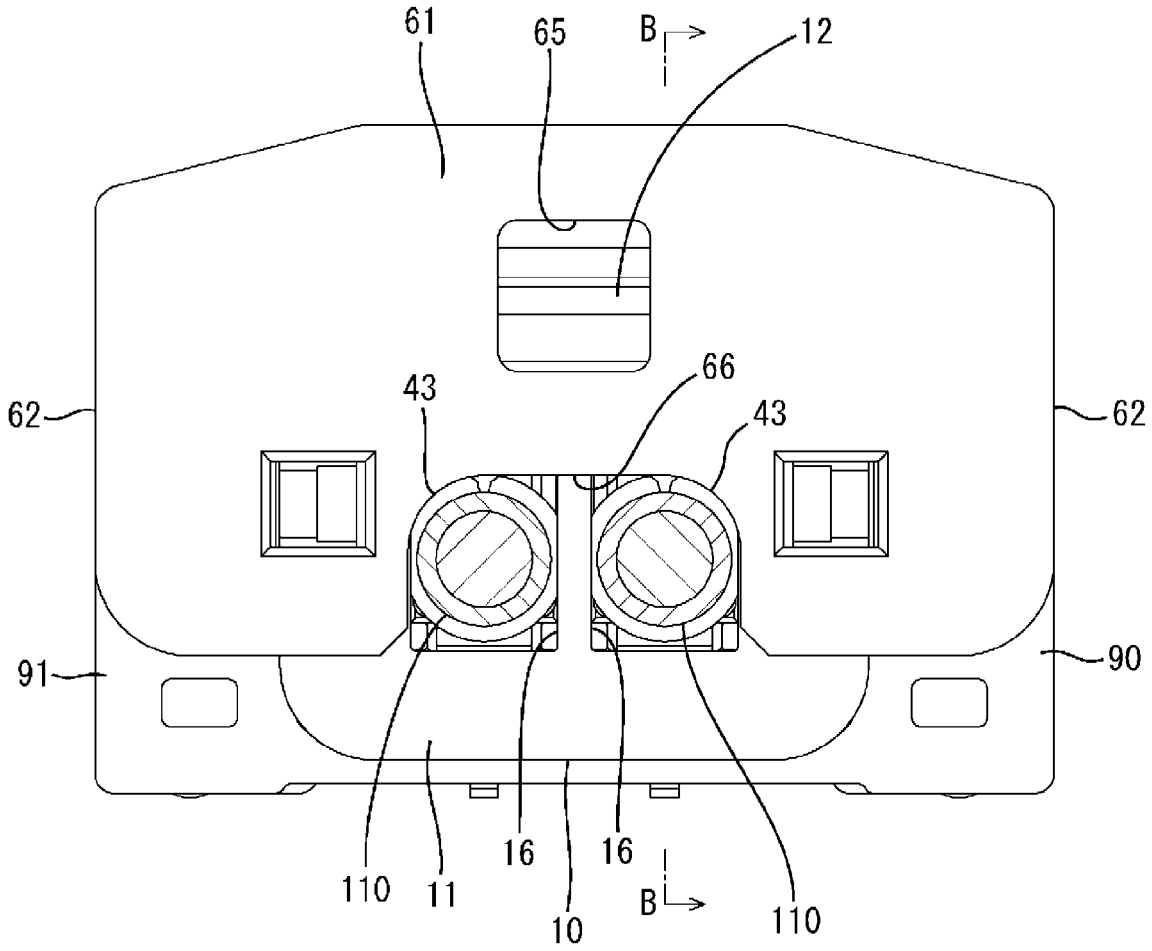
FIG. 2 is a back view showing the state where the housing is properly connected to the mating housing.

First, embodiments of the present disclosure are listed and described.

(1) The connector of the present disclosure is provided with a housing including a cavity, a terminal fitting to be inserted into the cavity from behind, the terminal fitting including a tubular box portion having open front and rear surfaces, a tab of a mating terminal fitting being inserted into the box portion from front, and a retainer to be mounted into the housing, the retainer including a detection piece capable of coming into contact with a rear end of the box portion, the detection piece including a recess for avoiding interference with the tab passed through the box portion. According to this configuration, even if a tip part of the tab protrudes rearward from an opening in the rear surface of the box portion, the interference of the tab and the detection piece can be avoided by the recess. Thus, functions of the detection piece can be properly exhibited without being hindered by the tab.

(2) The box portion may include a pair of side walls facing each other in a width direction and a bridge wall linking the both side walls, and the detection piece may have a detection surface in a gate-shaped part defining the recess and the detection surface may be capable of coming into contact with a rear end of a part extending the bridge wall to the both side walls. According to this configuration, since the detection surface of the detection piece can come into contact with a wide range of the box portion extending from the bridge wall to the both side walls via the recess, the reliability of the functions of the detection piece can be enhanced. Particularly, even if the connector is small in size, the escape of the terminal fitting from the cavity can be prevented with high reliability.

(3) The retainer may be mounted into the housing from behind, the terminal fitting may include a barrel portion to be connected to an end part of a wire behind the box portion, and the barrel portion may be arranged at a position lower than a contact region with the detection piece on the rear end of the box portion. According to this configuration, in the process of mounting the retainer into the housing, the interference of the detection piece and the barrel portion can be avoided and a state where the detection piece can come into contact with the rear end of the box portion can be satisfactorily realized.

<Embodiment>

One embodiment of the present disclosure is described with reference to FIGS. 1 to 9. A connector of this embodiment includes a housing 10, terminal fittings 40 to be accommodated into the housing 10 and a retainer 60 to be mounted into the housing 10. The housing 10 is connectable to a mating housing 90. Note that, in the following description, surface sides facing each other when the connection of the both housings 10, 90 is started are referred to as front sides concerning a front-rear direction. A vertical direction is based on a vertical direction of each figure except FIGS. 8 and 9.

<Mating Housing 90>

Figure 4:
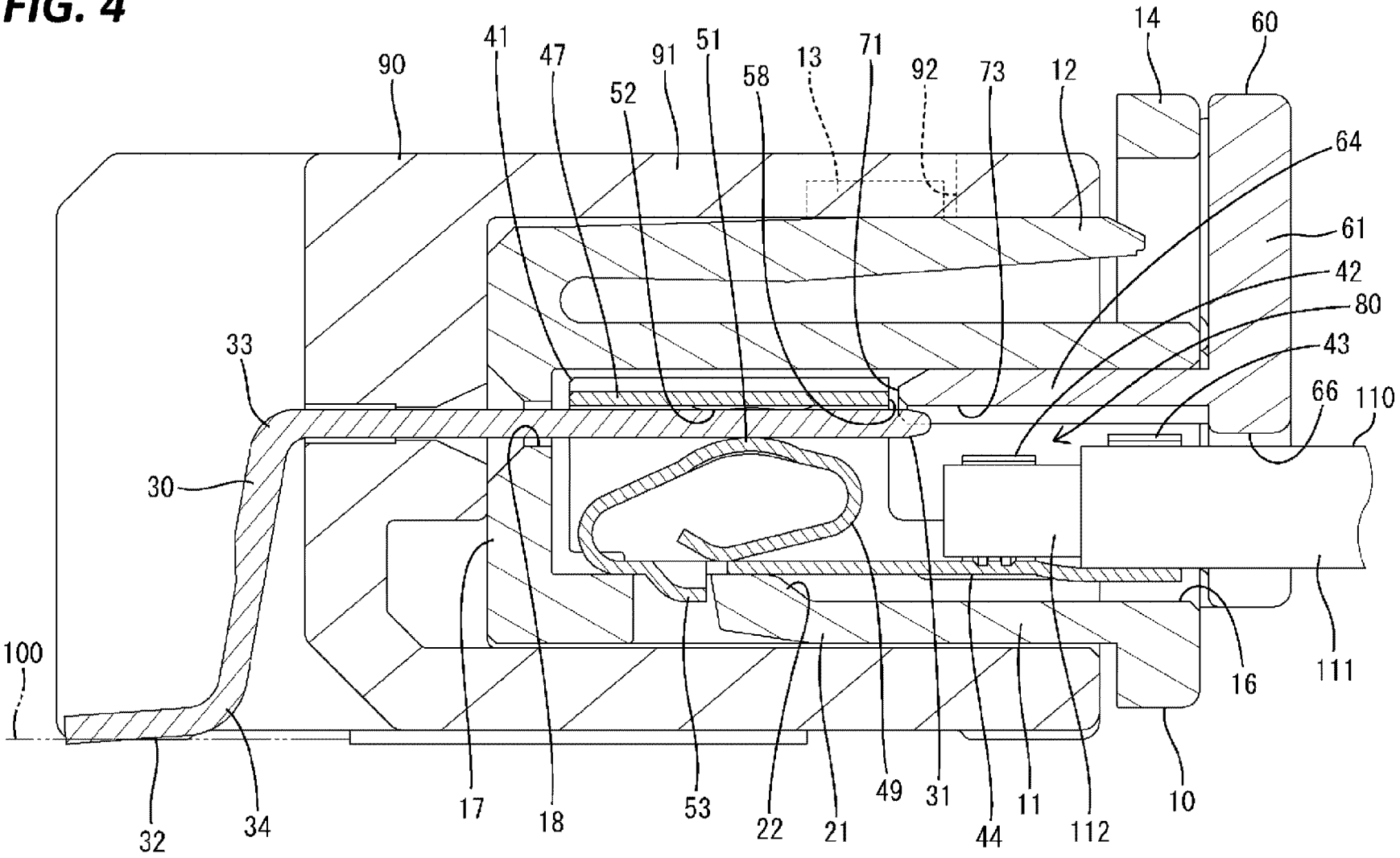
FIG. 4 is a section along B-B of FIG. 2.

The mating housing 90 is made of synthetic resin, includes a receptacle 91 in the form of a rectangular tube and is, as shown in FIG. 1, placed on the upper surface of a circuit board 100. A pair of left and right fixing members 95 (only one is shown in FIG. 1) are mounted on left and right side surfaces of the receptacle 91. The fixing members 95 are plate members made of metal and lower end parts thereof are soldered and connected to the upper surface of the circuit board 100 with the fixing members 95 mounted on the side surfaces of the receptacle 91. The mating housing 90 is fixed to the circuit board 100 via the both fixing members 95. As shown in FIG. 4, a lock hole 92 is provided to penetrate through an upper wall of the receptacle 91. A plurality of, in particular, a pair of left and right mating terminal fittings 30 are mounted in the mating housing 90.

<Mating Terminal Fittings 30>

As shown in FIG. 4, the mating terminal fitting 30 has an elongated shape as a whole, and includes a plurality of bent portions 33, 34 at intermediate positions in a length direction, a tab 31 projecting into the receptacle 91 on an upper-front side via the bent portion 33, and a board connecting portion 32 exposed to the outside of the receptacle 91 via the bent portion 34 and arranged along the upper surface of the circuit board 100 on a lower-rear side. The tab 31 is conductively connected to the terminal fitting 40 when the both housings 10, 90 are connected. The board connecting portion 32 is soldered and conductively connected to an unillustrated conductive portion formed on the upper surface of the circuit board 100. Note that the tab 31 has a rectangular cross-sectional shape.

<Housing 10>

Figure 3:
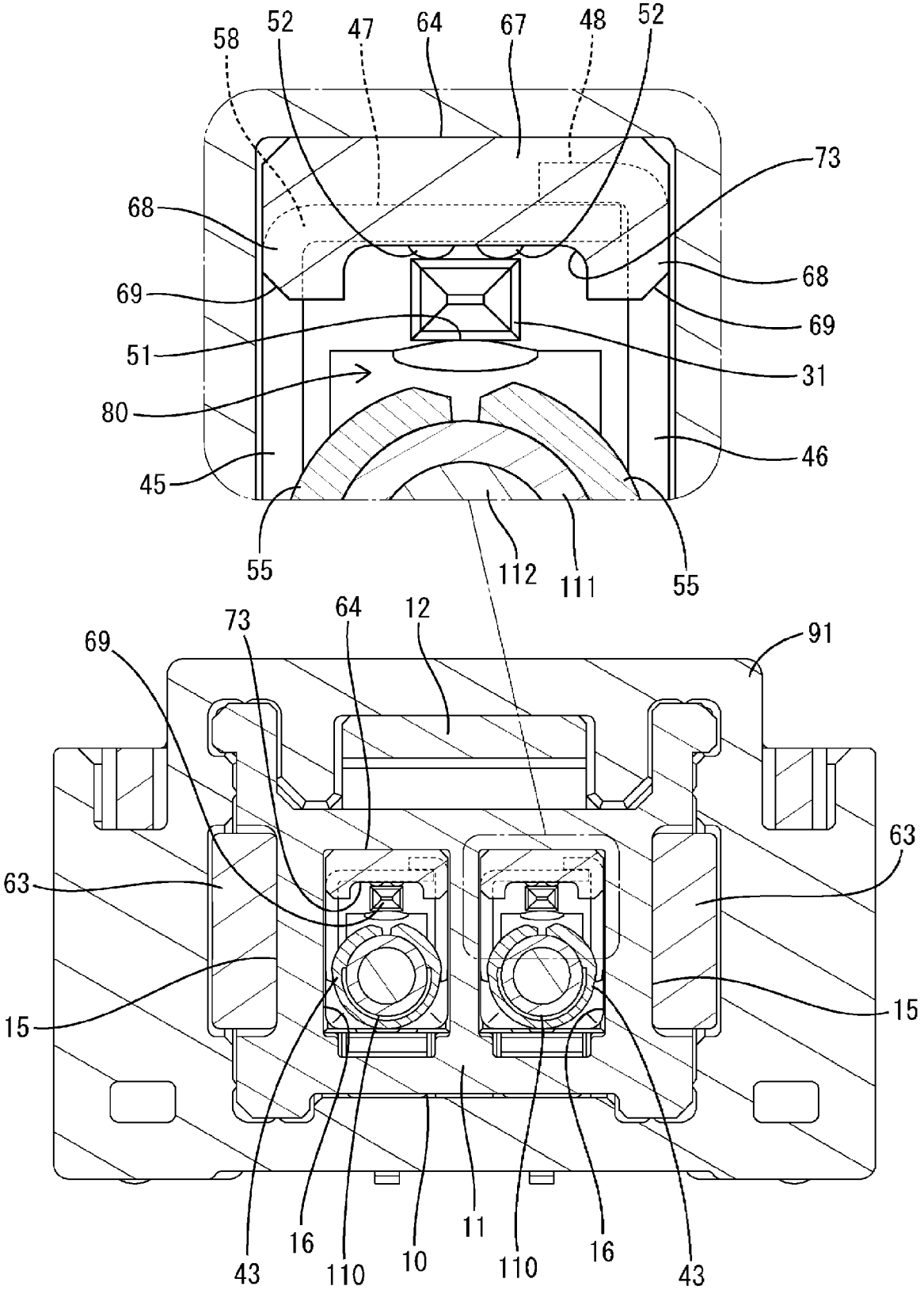
FIG. 3 is a section along A-A of FIG. 1.

The housing 10 is made of synthetic resin and includes, as shown in FIGS. 3 and 4, a housing body 11 in the form of a rectangular block. A deflectable lock arm 12 is provided on the upper surface of the housing body 11. As shown in FIG. 4, the lock arm 12 is cantilevered rearward from a base end part (part serving as a fulcrum of a deflection movement) connected to the upper surface of the housing body 11, and includes a lock portion 13 projecting upward. After the lock arm 12 is deflected and deformed, the lock portion 13 is fit into the lock hole 92 of the receptacle 91, whereby the both housings 10, 90 are held in a connected state. An arched protection wall 14 for covering a rear end part of the lock arm 12 is provided on a rear end part of the upper surface of the housing body 11.

As shown in FIG. 3, a pair of left and right recessed grooves 15 are provided in both side surfaces of the housing body 11. The both recessed grooves 15 are in the form of shallow grooves whose bottom surface parts are arranged along the vertical direction, and open in the rear surface of the housing body 11. Unillustrated projection-like locking structures for holding the retainer 60 are provided on the bottom surface parts of the both recessed grooves 15.

The housing body 11 is provided with a plurality of, in particular, a pair of left and right cavities 16. Each cavity 16 has a substantially rectangular opening cross-section having a vertical dimension larger than a lateral width. Each cavity 16 extends in the front-rear direction and the rear end thereof is open in the rear surface of the housing body 11. As shown in FIG. 4, the housing body 11 includes a front wall portion 17 for partially closing the front end of each cavity 16. A pair of left and right tab insertion holes 18 (only one is shown in FIG. 4) communicating with the respective cavities 16 are provided to penetrate through the front wall portion 17. The tabs 31 of the mating terminal fittings 30 are inserted into the cavities 16 through the tab insertion holes 18 of the housing body 11 from front.

Figure 9:
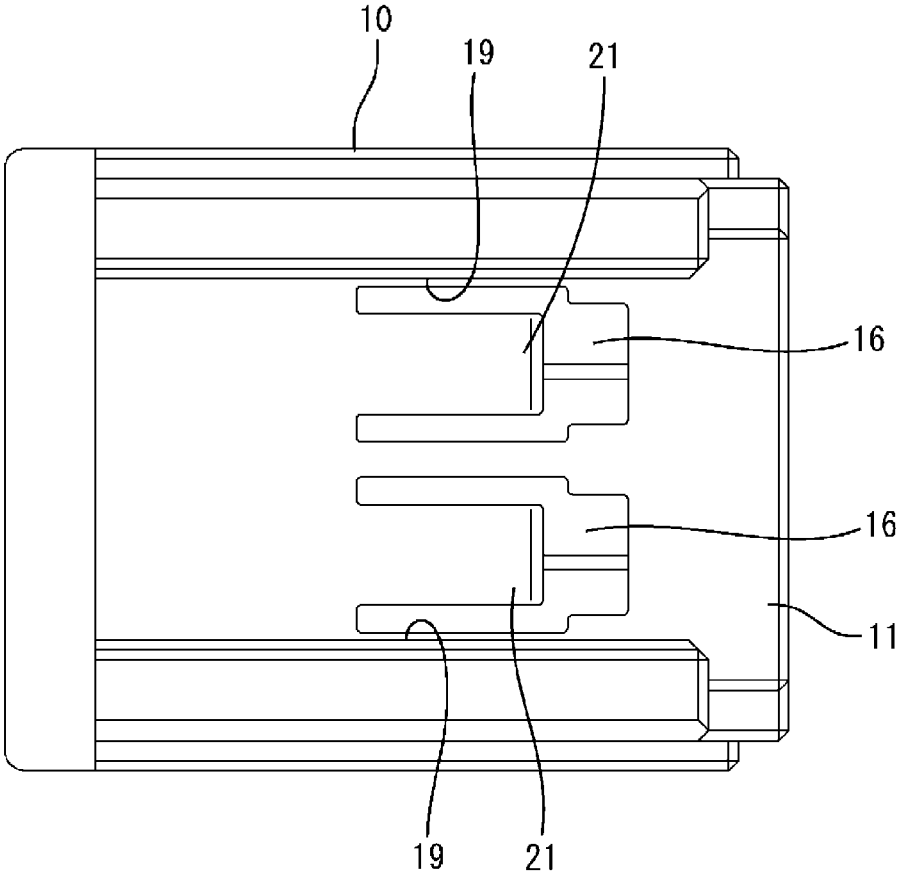
FIG. 9 is a bottom view of the housing.

As shown in FIG. 9, the housing body 11 includes a pair of left and right locking lances 21 at positions corresponding to the respective cavities 16 and in substantially gate-shaped cuts 19 formed in the lower surface of the housing body 11. The locking lance 21 can be deflected and deformed with a part connected to a central part in the front-rear direction of the lower wall of the cavity 16 serving as a fulcrum. As shown in FIG. 4, a front end part of the locking lance 21 is provided with a locking projection 22 projecting into the cavity 16.

The terminal fitting 40 is inserted into each cavity 16 of the housing body 11 from behind. The terminal fitting 40 is retained and held in the cavity 16 by being locked by the locking projection 22 of the locking lance 21.

<Terminal Fitting 40>

Figure 5:
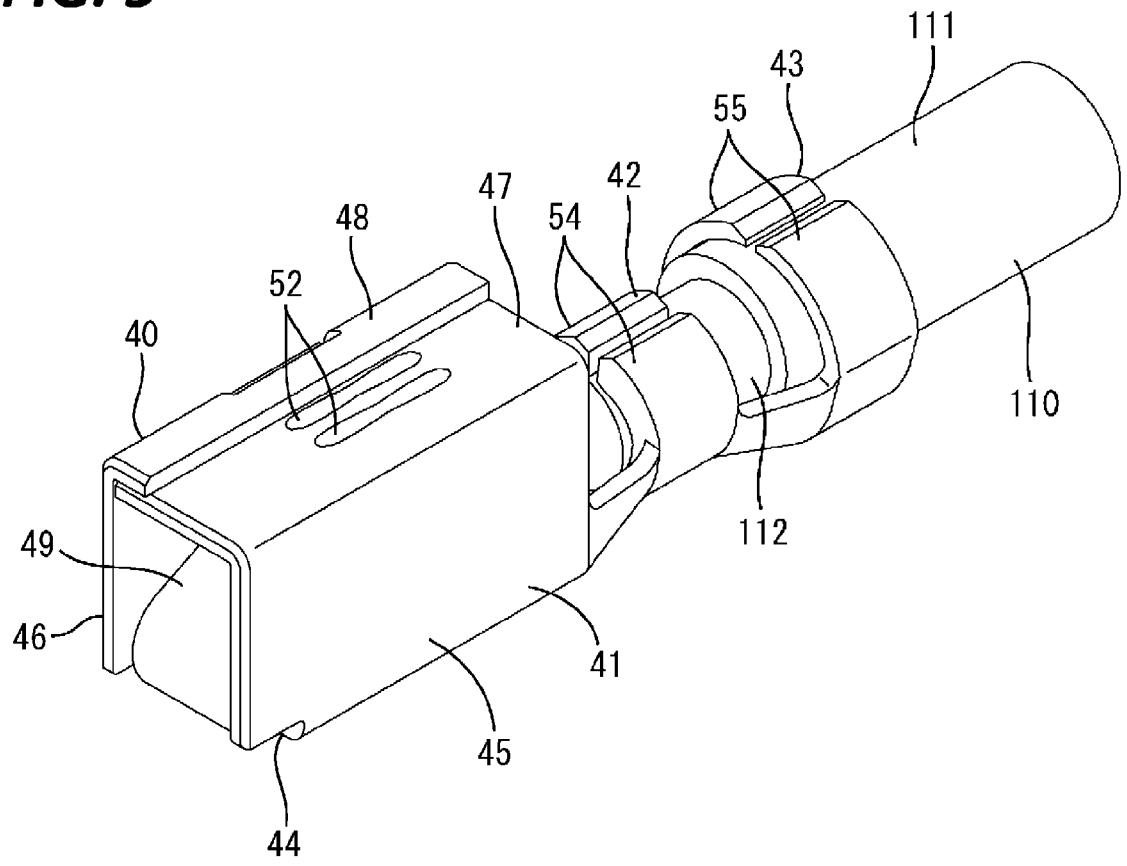
FIG. 5 is a perspective view of a terminal fitting connected to an end part of a wire.

The terminal fitting 40 is integrally formed, such as by bending a conductive metal plate. As shown in FIG. 5, the terminal fitting 40 includes a box portion 41 in a front part, barrel portions 42, 43 in a rear part and a bottom wall 44 extending from the front part (box portion 41) to the rear part (barrel portions 42, 43) on a lower end. The box portion 41 is in the form of a rectangular tube having open front and rear surfaces, and includes a pair of left and right side walls 45, 46 rising from both left and right ends of a front part of the bottom wall 44, a bridge wall 47 bent from one side wall 45 toward the other side wall 46 and extending between the both side walls 45 and 46, and a pressing wall 48 bent from the other side wall 47 toward the one side wall 45 for pressing the upper surface of the bridge wall 47 by being overlaid on an outer side of the bridge wall 47.

A resilient contact piece 49 is provided in the box portion 41. As shown in FIG. 4, the resilient contact piece 49 is curved into an annular shape by, after a tongue piece extending forward from the bottom wall 44 in a developed state is folded rearward, further folding a rear end part forward. The resilient contact piece 49 is deflectable and deformable with a forward folded end part in the rear end part held in contact with the inner surface of the bottom wall 44. An embossed contact point portion 51 is provided to project in an upper end part of the resilient contact piece 49.

As shown in FIGS. 3 and 5, the bridge wall 47 is provided with a pair of bead portions 52 projecting inward at positions facing the contact point portion 51 of the resilient contact piece 49. The tab 31 of the mating terminal fitting 30 is inserted and connected between the contact point portion 51 of the resilient contact piece 49 and the both bead portions 52.

As shown in FIG. 4, the bottom wall 44 is provided with a projection-like lance receiving portion 53 formed by being cut and raised downward at a position facing the folded end part of the resilient contact piece 49. The locking projection 22 of the locking lance 21 is lockable to the rear end of the lance receiving portion 53.

As shown in FIG. 5, the barrel portions 42, 43 are composed of the wire barrel portion 42 located on a front side and the insulation barrel portion 43 located on a rear side. The wire barrel portion 42 is in the form of an open barrel and includes a pair of left and right wire barrel pieces 54 rising from both left and right ends of an intermediate part in the front-rear direction of the bottom wall 44. The both wire barrel pieces 54 are wound on and crimped to a core 112 exposed by removing a coating 111 in an end part of a wire 110. The insulation barrel portion 43 is similarly in the form of an open barrel and includes a pair of insulation barrel pieces 55 rising from both left and right ends of a rear part of the bottom wall 44. The both insulation barrel pieces 55 are wound on and crimped to the coating 111 in the end part of the wire 110. The upper ends of the both insulation barrel pieces 55 in a crimped state are arranged above (at a higher position than) those of the both wire barrel pieces 54 in a crimped state and below (at a lower position than) an upper part (contact region 58 to be described later) of the box portion 41. That is, a vertical height of the box portion 41 is larger than those of the barrel portions 42, 43. Further, a length in the front-rear direction of the box portion 41 is larger than those of the barrel portions 42, 43.

<Retainer 60>

Figure 6:
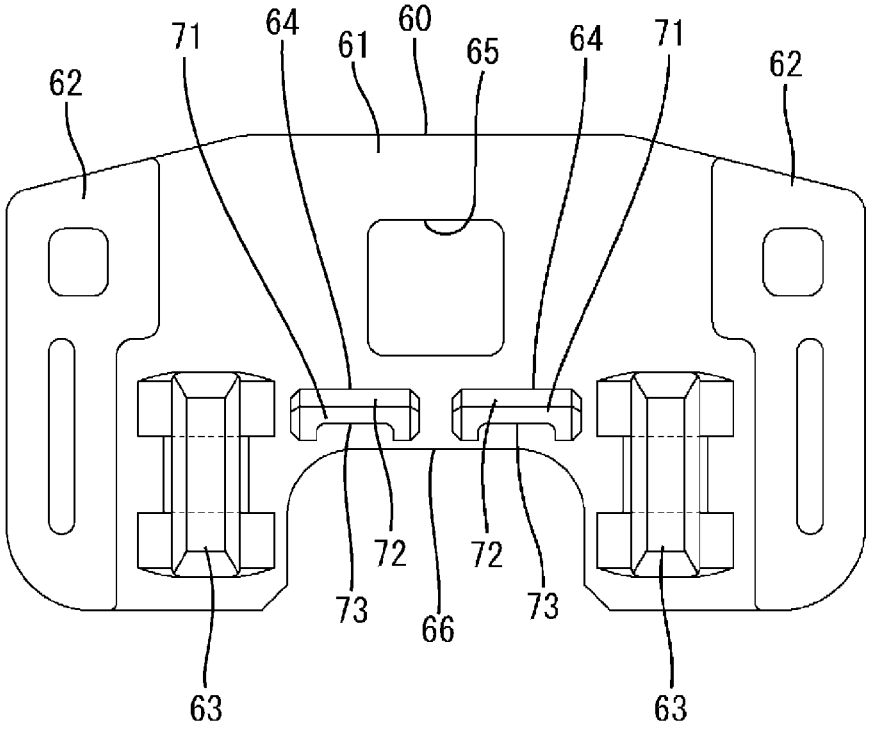
FIG. 6 is a front view of a retainer.
Figure 8:
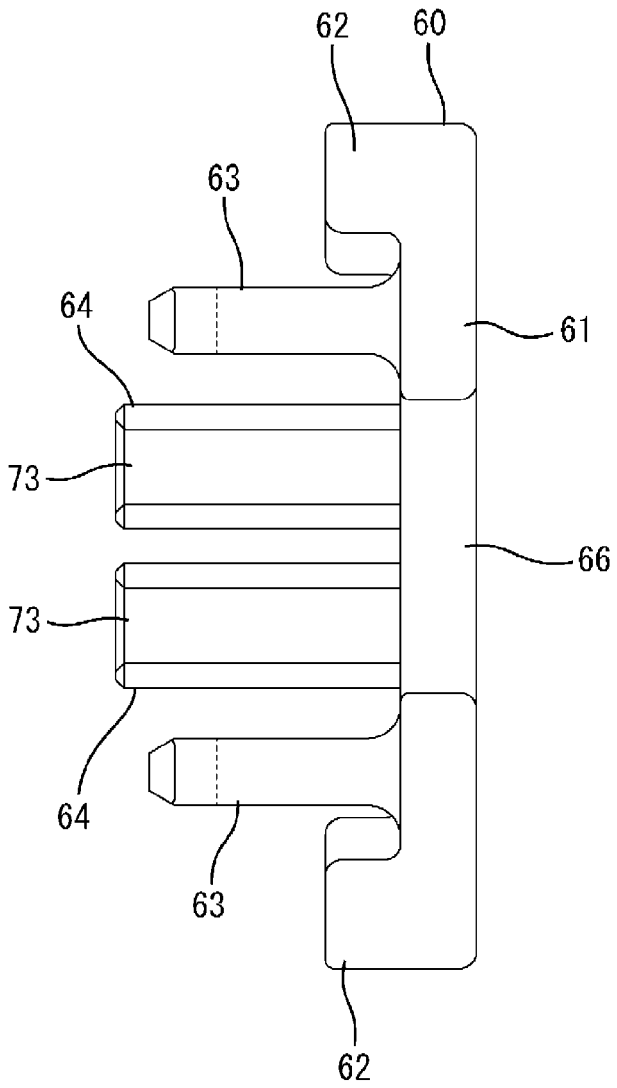
FIG. 8 is a bottom view of the retainer.

The retainer 60 is made of synthetic resin and includes, as shown in FIGS. 6 and 8, a retainer body 61 in the form of a flat plate to be arranged along a width direction (lateral direction), a pair of left and right protruding portions 62 connected to both left and right ends of the retainer body 61 and having parts projecting forward, a pair of lock pieces 63 inwardly of the both protruding portions 62 in the width direction and projecting forward from both left and right end sides of the retainer body 61, and a pair of left and right detection pieces 64 inwardly of the both lock pieces 63 in the width direction and projecting forward from a widthwise central side of the retainer body 61. As shown in FIG. 6, the both protruding portions 62 are connected to the retainer body 61 over an entire height. The both lock pieces 63 and the both protruding portions 62 are arranged laterally side by side in a lower part of the front surface of the retainer body 61. A hole portion 65 is provided to penetrate through an upper part of the widthwise central side of the retainer body 61. The hole portion 65 forms rectangular openings in the front and rear surfaces of the retainer body 61.

Figure 7:
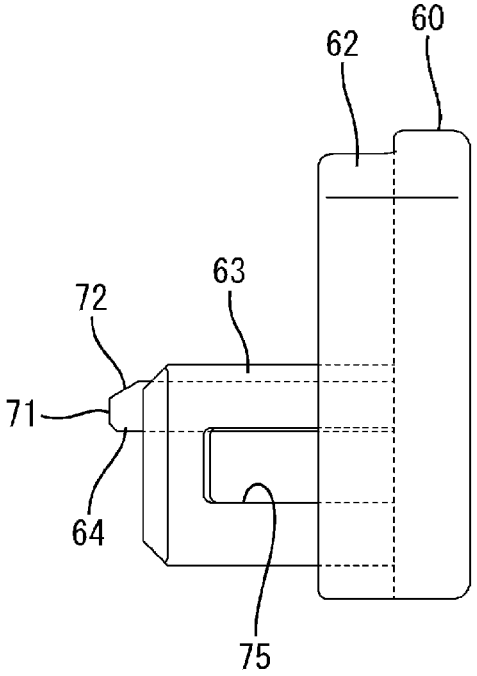
FIG. 7 is a side view of the retainer.

The lower end of the widthwise central side of the retainer body 61 is cut to provide a recess 66. The both detection pieces 64 are arranged side by side near the upper edge of the recess 66. The detection piece 64 is in the form of a plate piece having a predetermined width and projecting forward and, as shown in FIG. 7, has a larger projection dimension from the retainer body 61 than the lock piece 63 and the front end thereof is located forward of that of the lock piece 63. Specifically, as shown in FIG. 3, the detection piece 64 includes a detection body 67 along the width direction and a pair of left and right side portions 68 projecting downward from both left and right ends of the detection body 67 and is formed to have a constant gate-shaped cross-section substantially over an entire length in the front-rear direction. Lower end parts of the widthwise outer side surfaces of the both side portions 68 are chamfered to form tapered inclined surfaces 69.

A thickness in the vertical direction of the detection body 67 is equal to or larger than vertical dimensions of the bridge wall 47 and the pressing wall 48 stacked in the vertical direction in the box portion 41 of the terminal fitting 40. A width of the detection body 67 is equal to or larger than that of the box portion 41 of the terminal fitting 40. A thickness in the width direction of the side portion 68 is larger than those of the side walls 45, 46 in the box portion 41 of the terminal fitting 40.

As shown in FIG. 7, the front end surface (tip surface) of the detection piece 64 (detection body 67 and both side portions 68) is composed of a detection surface 71 arranged along the vertical direction and a slope 72 arranged to extend obliquely upward from the upper end of the detection surface 71 to the upper surface. The detection surface 71 of the detection piece 64 is gate-shaped to correspond to the detection body 67 and the both side portions 68 and, as shown in FIG. 4, can come into contact with the contact region 58 constituted by the bridge wall 47 and the rear ends of upper parts of the both side walls 45, 46 in the box portion 41.

As shown in FIG. 3, a recess 73 defined by the detection body 67 and the both side portions 68 is provided in a widthwise central part of the lower surface of each of the both detection pieces 64. Specifically, the recess 73 is defined by a back surface part arranged along the width direction and constituting the lower surface of the detection body 67, a pair of left and right side surface parts arranged along the vertical direction and constituting the inner surfaces (mutually facing surfaces) of the both side portions 68 and a pair of left and right curved back corner parts connecting the both side surface parts and the back surface part, and is open downward and forward. As shown in FIG. 7, the lock piece 63 is in the form of a plate frame along the vertical direction and includes a locking hole 75 penetrating in the lateral direction.

The retainer 60 is mounted into the housing 10 from behind with the both protruding portions 62 pinched with fingers. In the process of mounting the retainer 60 into the housing 10, the both detection pieces 64 are inserted into the corresponding cavities 16 from behind and the both lock pieces 63 enter the corresponding recessed grooves 15 (see FIG. 3). When the retainer 60 is mounted into the housing 10, the unillustrated locking structures are resiliently fit into the locking holes 75 of the both lock pieces 63. In this way, the retainer 60 is held in the housing 10 with separation restricted.

Further, when the retainer 60 is mounted into the housing 10, the retainer body 61 is located behind the housing 10, the hole portion 65 faces a rear end part of the lock arm 12, the both protruding portions 62 protrude toward both sides in the width direction from the housing body 11 and the recess 66 communicates with the openings in the rear surfaces of the respective cavities 16 of the housing body 11.

<Assembling Structure>

In assembling, the terminal fittings 40 are inserted into the cavities 16 of the housing body 11 from behind. When the terminal fittings 40 are properly inserted, forward movements of the terminal fittings 40 are restricted by the front wall portion 17, rearward movements thereof are restricted by locking the locking projections 22 to the lance receiving portions 53 and the terminal fittings 40 are primarily retained in the cavities 16 (see FIG. 4). A clearance 80 due to a height difference between the barrel portions 42, 43 and the box portion 41 is formed on an upper-rear side in the cavity 16 of the housing body 11. Further, the wire 110 connected to the terminal fitting 40 is pulled out rearward from the cavity 16 of the housing body 11.

Subsequently, the retainer 60 is mounted into the housing body 11 from behind. The retainer body 61 avoids interference with the wires 110 by the wires 110 entering the recess 66 (see FIGS. 2 and 4). The detection pieces 64 are inserted into the clearances 80 along the upper walls in the cavities 16 after the slopes 72 are guided slidably on the upper ends of the openings in the rear surfaces of the cavities 16. With the retainer 60 mounted in the housing 10, the detection surfaces 71 of the detection pieces 64 are arranged to face the rear ends of the upper parts of the box portions 41, in particular, the contact regions 58, which are the rear ends of parts extending from the bridge walls 47 including the pressing walls 48 to upper parts of the both side walls 45, 46 (see FIGS. 3 and 4).

If the terminal fitting 40 is not inserted to a proper depth into the cavity 16, the detection piece 64 strongly comes into contact with the contact region 58 of the box portion 41 and it can be detected that the terminal fitting 40 is left in an insufficiently inserted state. Further, by strongly pushing the retainer 60 from that state and mounting the retainer 60 into the housing body 11, the terminal fitting 40 can be pushed by the detection piece 64 and brought to a proper insertion position.

With the terminal fitting 40 properly inserted in the cavity 16, the detection surface 71 of the detection piece 64 is arranged to face the contact region 58 of the box portion 41 as described above. Thus, the terminal fitting 40 is secondarily retained in the cavity 16. Even if the wire 110 is pulled rearward, the contact region 58 of the box portion 41 comes into contact with the detection surface 71 of the detection piece 64, whereby any further rearward movement of the terminal fitting 40 is restricted and the inserted state of the terminal fitting 60 in the cavity 16 is maintained.

Subsequently, the housing 10 is fit into the receptacle 91 of the mating housing 90 with the both protruding portions 62 pinched with fingers. If the housing 10 is fit into the receptacle 91, the lock portion 13 of the lock arm 12 is fit into the lock hole 92 and the both housings 10, 90 are held in a retained state (see FIG. 4). At this time, the lock arm 12 is arranged in the receptacle 91, the rear end part thereof is surrounded by the protection wall 14 and the retainer body 61 is located behind the lock arm 12. Thus, the lock arm 12 is less likely to interfere with external matters. As a result, it is prevented that a locked state of the lock arm 12 and the lock hole 92 is released due to interference with an external matter.

On the other hand, in separating the both housings 10, 90, a jig is inserted into the hole portion 65 of the retainer body 61 from behind and a tip part of the jig is brought into contact with the rear end part of the lock arm 12 to push down the rear end part of the lock arm 12. Then, the lock portion 13 comes out from the lock hole 92, the locked state of the lock arm 12 and the lock hole 92 is released, and the both housings 10, 90 can be pulled apart from each other.

If the both housings 10, 90 are properly connected, the tab 31 of the mating terminal fitting 30 enters the box portion 41 through the tab insertion hole 18. The tab 31 is sandwiched between the contact point portion 51 and the both bead portions 52 while deflecting the resilient contact piece 49. By bringing the tab 31 into contact with the contact point portion 51 in this way, the both terminal fittings 30, 40 are properly electrically connected.

In the case of this embodiment, since the connector is small in size, a rear end part (tip part) of the tab 31 may protrude rearward from the rear end of the box portion 41 within an error or dimensional tolerance range. However, as shown in FIG. 4, the rear end part of the tab 31 can enter the recess 73 to avoid interference with the detection piece 64 while protruding rearward from the rear end of the box portion 41. Specifically, since the recess 73 of the detection piece 64 is arranged at a position facing the tab 31 in a moving direction of the tab 31, an upper part of the tab 31 enters a widthwise central part of the recess 73, the upper surface of the tab 31 is arranged parallel to and in proximity to the lower surface of the detection body 67, and the tab 31 and the detection piece 64 are held in a non-contact state.

Thus, according to this embodiment, the tab 31 protruding from the box portion 41 can enter the recess 73 and avoid interference with the detection piece 64. Therefore, a state where the detection surface 71 of the detection piece 64 can come into contact with the contact region 58 of the box portion 41 can be satisfactorily maintained, and a retaining function and a detecting function by the detection piece 64 can be properly exhibited.

Particularly, the detection piece 64 has the gate-shaped detection surface 71 defining the recess 73, the detection surface 71 can come into contact with the contact region 58 on the rear end of the box portion 41 of the terminal fitting 40, and the contact region 58 is formed in a wide range extending not only over the bridge wall 47, but also over the pressing wall 48 and the upper parts of the both side walls 45, 46. Thus, reliability in restricting the escape of the terminal fitting 40 from the cavity 16 can be further enhanced.

Further, the box portion 41 is taller than the barrel portions 42, 43 and the clearance 80 due to the height difference between the box portion 41 and the barrel portions 42, 43 is formed on the upper-rear side in the cavity 16. Thus, in the process of mounting the retainer 60, the detection pieces 64 can be inserted into the clearances 80 and prevented from contacting the barrel portions 42, 43, and an operation of mounting the retainer 60 into the housing 10 can be smoothly performed.

<Other Embodiments of Present Disclosure>

The embodiment disclosed this time should be considered illustrative in all aspects rather than restrictive. For example, the following embodiments can be adopted.

(1) A retainer mounting hole communicating with the cavities may be provided in the upper surface, the side surface or the like of the housing body, the retainer may be inserted into the retainer mounting hole from a direction intersecting the front-rear direction with respect to the housing, and the detection pieces may be able to come into contact with the rear ends of the box portions of the terminal fittings.

(2) The tip part of the tab may protrude rearward from the rear end of the box portion not because of an error or dimensional tolerance, but because of a design.

(3) A male terminal fitting may have a barrel structure to be connected to an end part of a wire without being connected to the circuit board and include a tab projecting forward. In this case, a male housing is not placed on the upper surface of the circuit board and possibly has such a structure that fixing members are not mounted.

LIST OF REFERENCE NUMERALS

10 . . . housing
11 . . . housing body
12 . . . lock arm
13 . . . lock portion
14 . . . protection wall
15 . . . recessed groove
16 . . . cavity
17 . . . front wall portion
18 . . . tab insertion hole

19 . . . cut
21 . . . locking lance
22 . . . locking projection
30 . . . mating terminal fitting
31 . . . tab
32 . . . board connecting portion
33, 34 . . . bent portion
40 . . . terminal fitting
41 . . . box portion
42 . . . wire barrel portion
43 . . . insulation barrel portion
44 . . . bottom wall
45 . . . one side wall
46 . . . another side wall
47 . . . bridge wall
48 . . . pressing wall
49 . . . resilient contact piece
51 . . . contact point portion
52 . . . bead portion
53 . . . lance receiving portion
54 . . . wire barrel piece
55 . . . insulation barrel piece
58 . . . contact region
60 . . . retainer
61 . . . retainer body
62 . . . protruding portion
63 . . . lock piece
64 . . . detection piece
65 . . . hole portion
66 . . . recess
67 . . . detection body
68 . . . side portion
69 . . . inclined surface
71 . . . detection surface
72 . . . slope
73 . . . recess
75 . . . locking hole
80 . . . clearance
90 . . . mating housing
91 . . . receptacle
92 . . . lock hole
95 . . . fixing member
100 . . . circuit board
110 . . . wire
111 . . . coating
112 . . . core

What is claimed is:

1. A connector, comprising:

a housing including a cavity;

a terminal fitting to be inserted into the cavity from behind, the terminal fitting including a tubular box portion having open front and rear surfaces, a tab of a mating terminal fitting being inserted into the box portion from front; and a retainer to be mounted into the housing, the retainer including a detection piece capable of coming into contact with a rear end of the box portion, the detection piece including a recess for avoiding interference with the tab passed through the box portion.

2. The connector of claim 1, wherein:

the box portion includes a pair of side walls facing each other in a width direction and a bridge wall linking the both side walls, and the detection piece has a detection surface in a gate-shaped part defining the recess and the detection surface is capable of coming into contact with a rear end of a part extending the bridge wall to the both side walls.

3. The connector of claim 1, wherein:

the retainer is mounted into the housing from behind, the terminal fitting includes a barrel portion to be connected to an end part of a wire behind the box portion, and the barrel portion is arranged at a position lower than a contact region with the detection piece on the rear end of the box portion.

* * * * *